US006459212B2

(12) United States Patent
Tokunaga et al.

(10) Patent No.: US 6,459,212 B2
(45) Date of Patent: Oct. 1, 2002

(54) METHOD OF DRIVING PLASMA DISPLAY PANEL AND PLASMA DISPLAY APPARATUS

(75) Inventors: Tsutomu Tokunaga; Shigeo Ide, both of Yamanashi (JP)

(73) Assignee: Pioneer Corporation, Tokyo (JP)

( * ) Notice: Subject to any disclaimer, the term of this patent is extended or adjusted under 35 U.S.C. 154(b) by 0 days.

(21) Appl. No.: 09/883,426

(22) Filed: Jun. 19, 2001

(30) Foreign Application Priority Data

Jun. 26, 2000 (JP) ..... 2000-191183

(51) Int. Cl.[7] ..... G09G 3/10

(52) U.S. Cl. ..... 315/169.4; 315/169.2; 345/60; 345/67; 345/211; 345/214

(58) Field of Search ..... 315/169.2, 169.4; 345/204, 208, 211, 212, 214, 60, 67

(56) References Cited

U.S. PATENT DOCUMENTS 6,175,194 B1 * 1/2001 Saegusa et al. ..... 315/169.1
6,369,782 B2 * 4/2002 Shigeta ..... 345/60

* cited by examiner

*Primary Examiner*—Don Wong
*Assistant Examiner*—Thuy Vinh Tran
(74) *Attorney, Agent, or Firm*—Sughrue Mion, PLLC

(57) ABSTRACT

A method for driving a plasma display panel and a plasma display apparatus are devised to prevent a deterioration in contrast in displaying an image having low brightness. In applying a reset pulse having a gradual change in a level at a front edge portion to all of discharge cells, a time period before the level at the front edge portion reaches a predetermined level is adjusted in accordance with an average brightness of a displayed image.

9 Claims, 9 Drawing Sheets

PRIOR ART

METHOD OF DRIVING PLASMA DISPLAY PANEL AND PLASMA DISPLAY APPARATUS

BACKGROUND OF THE INVENTION

1. Field of the Invention

The present invention relates to a plasma display apparatus including a plasma display panel.

2. Description of Related Art

In recent years, with the increase in screen size of display apparatuses, the demand for thin shape display devices is increasing and various kinds of thin display device have been put into the practical use. A plasma display panel of an alternating current discharge type has attracted much attention as one type of the thin shape display device.

FIG. 1 is a view schematically showing the construction of a plasma display apparatus equipped with such a plasma display panel.

In FIG. 1, PDP 10 as a plasma display panel is provided with m of column electrodes $D_1$ through $D_m$ and respective n of row electrodes $X_1$ through $X_n$ and row electrodes $Y_1$ through $Y_n$ aligned to intersect with the respective column electrodes. The row electrodes $X_1$ through $X_n$ and the row electrodes $Y_1$ through $Y_n$, constitute a 1-th display line through an n-th display line in PDP 10 by respective pairs of row electrodes $X_i$ ($1 \leqq i \leqq n$) and $Y_i$ ($1 \leqq i \leqq n$). The PDP 10 is constructed in such a way that discharge spaces enclosing a discharge gas are formed between the column electrodes D and the row electrodes X and Y and discharge cells constituting pixels are formed. at intersecting portions of the respective row electrode pairs and the column electrodes including the discharge spaces.

In this case, the respective discharge cell has only two states of "light emission" and "no light emission", since light is emitted by utilizing a discharge phenomenon. That is, the PDP 10 is capable of displaying only brightness of two gray scales of lowest brightness (non light emitting state) and highest brightness (light emitting state).

Hence, a driver 100 carries out a gray-scale drive using the subfield method for the PDP 10 in order to realize the display with halftone brightness in accordance with an inputted image signal.

According to the subfield method, an inputted image. signal is converted into, for example, corresponding 4 bit pixel data for each of the pixels. In correspondence respectively with the bit digits of the four bits, 1 field is constituted by four subfields SF1 through SF4 as shown in FIG. 2.

FIG. 3 is a diagram showing various drive pulses applied by the driver 100 on the row electrodes and the column electrodes of PDP 10 and application timings thereof in one subfield.

First, at simultaneous resetting step Rc, the driver 100 applies reset pulses $RP_X$ having a positive polarity simultaneously to the respective row electrodes $X_1$ through $X_n$ and applies reset pulses $RP_Y$ having a negative polarity simultaneously to the respective row electrodes $Y_1$ through $Y_n$ as shown in FIG. 3. In accordance with application of the reset pulses $RP_X$ and $RP_Y$, all of the discharge cells of PDP 10 are discharged to reset. After finishing the reset discharge, a predetermined amount of wall charge is uniformly formed in the respective discharge cells and the wall charge is maintained.

By executing the simultaneous resetting step Rc, all of the discharge cells in PDP 10 are initialized to the state (sustaining discharge) capable of emitting light in a light emission sustaining step Ic, mentioned later (hereinafter, referred to as "light emitting cell" state).

Next, at a pixel data writing step Wc, the driver 100 separates respective bits of the 4 bit pixel data in correspondence with the respective subfields SF1 through SF4 and generates pixel data pulses having a pulse voltage in accordance with the logical level of the corresponding bit. For example, at pixel data writing step Wc of the subfield SF1, the driver 100 generates a pixel data pulse having a pulse voltage in accordance with the logical level of the first bit of the pixel data. In this process, the driver 100 generates a pixel data pulse having a pulse voltage of high voltage when the logical level of the first bit is "1", or low voltage (0 volt) when the logical level of the first bit is "00". Further, the driver 100 applies the pixel data pulses successively to the column electrodes $D_1$ through $D_m$ as shown in FIG. 3 as a group of pixel data pulses $DP_1$ through $DP_n$ for respective single display line in correspondence with each of the 1-th through the n-th display lines. Further, the driver 100 generates a scan pulse SP having a negative polarity as shown in FIG. 3 in synchronism with an application timing of each of the respective pixel data pulse group DP and applies it successively to the row electrodes $Y_1$ through $Y_n$. With this operation, there causes discharge (selective erasure discharge) only at the discharge cell at a portion intersected with the display line applied with the scan pulse SP and "column" applied with the pixel data pulse having high voltage. By the selective erasure discharge, wall charge held in the discharge cell is extinguished and the discharge cell is shifted to a state of being incapable of emitting light (sustaining discharge) in the light emission sustaining step Ic, mentioned later (hereinafter, referred to as "no light emitting cell"). Meanwhile, the selective erasure discharge is not caused in the discharge cell applied with the pixel data pulse having low voltage even when the discharge cell is applied with the scan pulse SP and the discharge cell maintains the state of being initialized at the simultaneous resetting step Rc, that is, the state of "light emitting cell".

That is, according to the pixel data writing step Wc, the respective discharge cell of PDP 10 is set to either of the "light emitting cell" state and the "no light emitting cell" state in accordance with the pixel data based on the inputted image signal.

Next, at the light emission sustaining step Ic, as shown in FIG. 3, the driver 100 applies sustaining pulses $IP_X$ having a positive polarity and sustaining pulses $IP_Y$ having a positive polarity respectively to the row electrodes $X_1$ through $X_n$ and the row electrodes $Y_1$ through $Y_n$ alternately repeatedly. Further, the number of times (periods) of application of the sustaining pulses $IP_X$ and $IP_Y$ in one subfield are set in accordance with weighting of the respective subfields as shown in FIG. 2. In this process, only the discharge cell at which wall charge is present, that is, the discharge cell brought into the "light emitting cell" state, carries out a sustaining discharge each time the sustaining pulses $IP_X$ and $IP_Y$ are applied. That is, only the discharge cell set to the "light emitting cell" state in the pixel data writing step Wc, repeats light emission in accordance with sustaining discharge by the number of times set in correspondence with the weighting of the respective subfield as shown in FIG. 2, and maintains the light emitting state.

The driver 100 carries out the above-described operation for the respective subfield. The brightness of an intermediate tone in correspondence with the image signal is expressed by a total number of light emission (in one field) associated with the sustaining discharge created in the respective subfield. That is, by the light emission associated with the sustaining discharge, an image in correspondence with the image signal is displayed.

However, according to the above-described driving operation utilizing the discharge phenomenon, discharges accompanied by light emission which are not related to the display image, that is, the resetting discharge and selective erasure discharge must also be produced. Particularly, as a result of the reset discharge, all of the discharge cells simultaneously emit light. Therefore, there arises a problem that, when displaying a black image or an image having a extremely low brightness near to the black peak, a deterioration in contrast becomes remarkable.

OBJECT AND SUMMARY OF THE INVENTION

The invention has been made in view of the above-described problem and it is an object of the present invention to provide a method of driving a plasma display panel and a plasma display apparatus capable of preventing a deterioration of contrast in displaying an image having low brightness.

According to one aspect of the invention, there is provided a method for driving a plasma display panel in accordance with an image signal, said plasma display panel having a plurality of discharge cells constituting display pixels arranged in a matrix form, the method comprising: a simultaneous resetting step for applying reset pulses having gradual level changes at front edge portions thereof to each of the discharge cells to cause a reset discharge for initializing the respective discharge cells to either of a light emitting cell state and a non light emitting cell state; a pixel data writing step for applying a scan pulse for causing selective discharge to the-respective discharge cells to shift the discharge cells selectively to the non light emitting cell state or the light emitting cell state in accordance with pixel data corresponding to the image signal, and a-light emission sustaining step of applying to each of the discharge cells sustaining pulses for causing sustaining discharge for causing only the discharge cells brought into the light emitting cell state to emit light repeatedly, wherein the simultaneous resetting step includes a reset pulse waveform adjusting step of adjusting a time period before the level at the front edge portion of the reset pulse reaches a predetermined level, in accordance with an average brightness level of the image signal.

According to another aspect of the invention, there is provided a plasma display apparatus for driving a plasma display panel having capacitive discharge cells constituting display pixels arranged in a matrix form in accordance with an image signal, the apparatus comprising a reset pulse generating part for generating reset pulses for creating reset discharge for initializing each of the discharge cells to either of a light emitting cell state and a no light emitting cell state, a light emission driving part for selectively shifting the discharge cells to the non light emitting cell state or the light emitting cell state in accordance with the image signal and causing only the discharge cells brought into the light emitting cell state to emit light repeatedly, and an average brightness level measuring part for measuring an average brightness level of the image signal, wherein the reset pulse generating part comprises a power source for generating direct current power source voltage having a voltage value the same as a voltage value of pulse voltage in the reset pulse, a part for generating the reset pulse by applying the direct current power source voltage to the respective discharge cells via resistors, and a reset pulse waveform adjusting part for adjusting time constants of C-R circuits each comprising the discharge cell as a capacitive load and the resistor in accordance with the average brightness level.

DETAILED DESCRIPTION OF THE PREFERRED EMBODIMENTS

A detailed explanation will be given of embodiments of the invention with reference to the drawings as follows.

Figure 1:
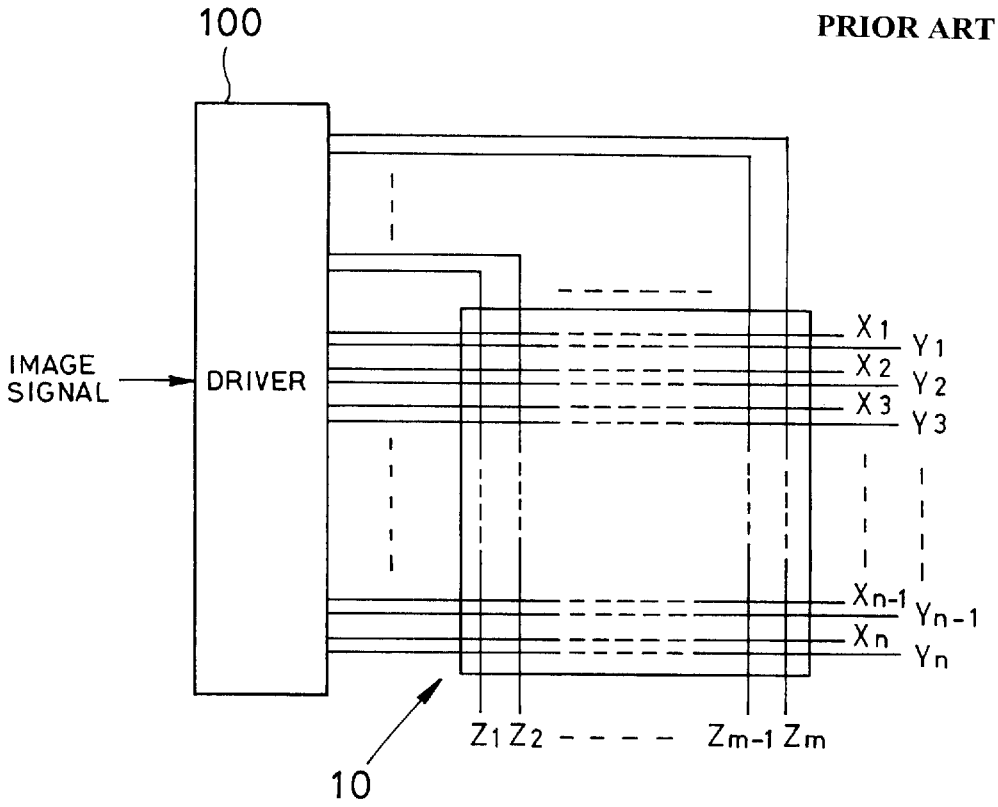
FIG.1 PRIOR ART
FIG. 1 is a view showing an outline constitution of a plasma display apparatus.
Figure 2:
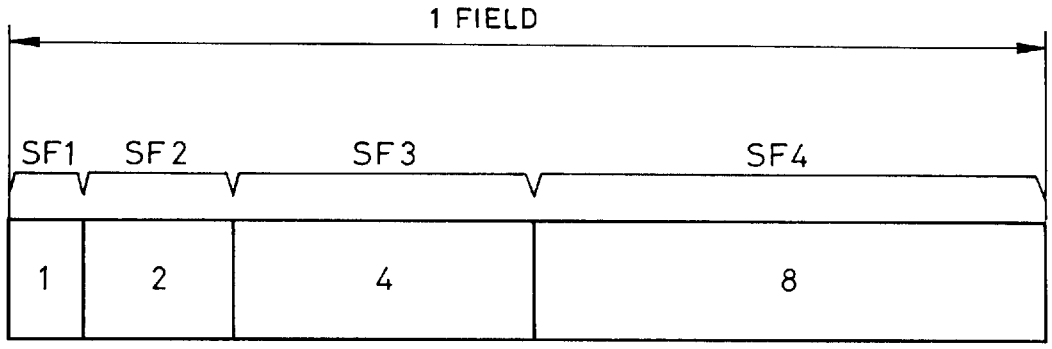
FIG.2 PRIOR ART
FIG. 2 is a diagram showing an example of a light emission drive format.
Figure 3:
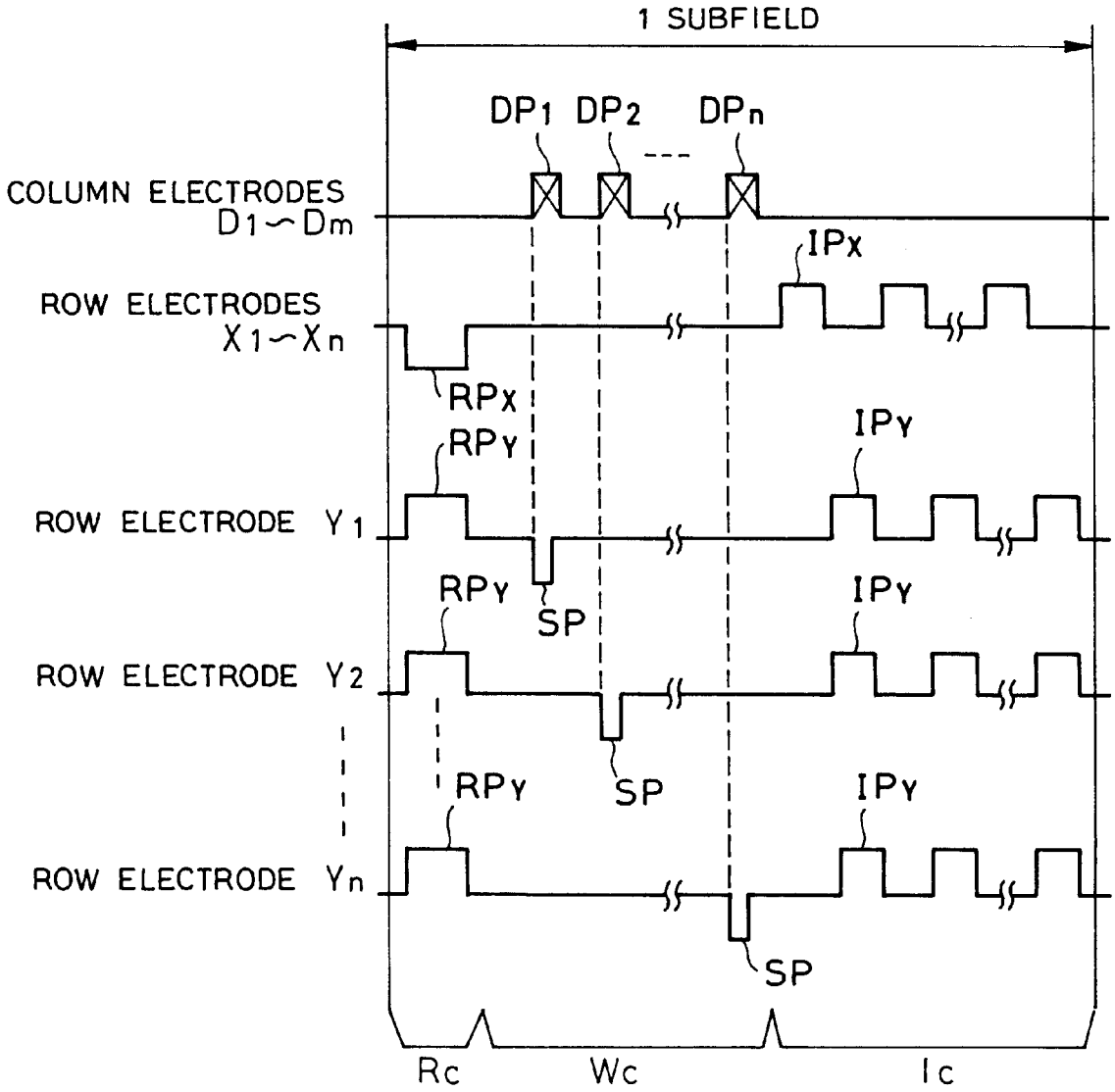
FIG. 3 is a diagram showing drive pulses applied to PDP 10 in 1 subfield and application timings thereof.
Figure 4:
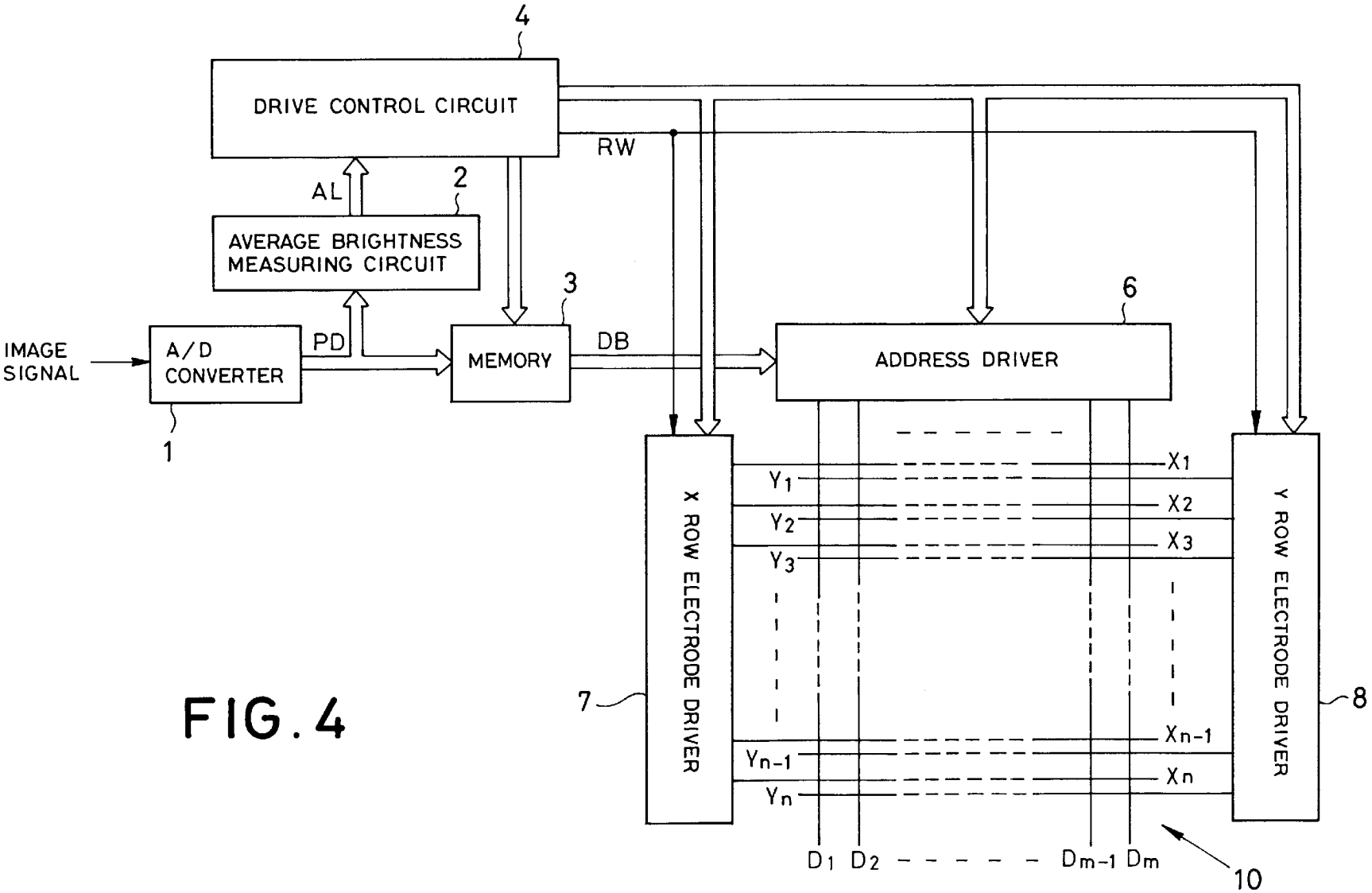
FIG. 4 is a diagram showing a constitution of a plasma display apparatus for driving a plasma display panel in accordance with a driving method according to the invention.

FIG. 4 is a view showing the structure of a plasma display apparatus in which a plasma display panel is driven in accordance with a driving method according to the invention.

In FIG. 4, PDP 10 as a plasma display panel is provided with m column-electrodes $D_1$ through $D_m$ and row electrodes $X_1$ through $X_n$ and row electrodes $Y_1$ through $Y_n$ both of which are n in number, and are aligned to intersect with the respective column electrodes. The row electrodes $X_1$ through $X_n$ and the row electrodes $Y_1$ through $Y_n$ constitute a first display line-through an n-th display line in PDP 10 with respective pairs of row electrodes $X_i$ ($1 \leqq i \leqq n$) and $Y_i$ ($1 \leqq i \leqq n$). The PDP 10 has a construction in which discharge spaces including a discharge gas are formed between the column electrodes D and the row electrodes X and Y and discharge cells which constitute display pixels are formed at respective portions intersected with the respective row electrode pairs and the column electrodes including the discharge spaces in a matrix shape.

An A/D converter 1 samples an inputted image signal and converts the signal into pixel data PD of N bits representing a brightness level for respective pixel.

An average brightness level measuring circuit 2 calculates an average brightness level based on the pixel data PD of, for example, one screen and supplies an average brightness signal AL indicating the average brightness level to a drive control circuit 4.

A memory 3 is successively written with the pixel data PD in accordance with a write signal supplied from the drive control circuit 4. Further, when writing of one screen, that is, (n×m) of the pixel data PD from pixel data $PD_{11}$ in correspondence with a pixel of 1-th row and 1-th column up to pixel data $PD_{nm}$ in correspondence with a pixel of n-th row and m-th column, is completed, the memory 3 carries out the following reading operation. First, the memory 3 takes respective first bits of the pixel data $PD_{11}$ through $PD_{nm}$ as pixel drive data bits $DB1_{11}$ through $DB1_{nm}$, reads them by respective single display line in accordance with read addresses supplied from the drive control circuit 4 and supplies them to an address driver 6. Next, the memory 3 takes respective 2-th bits of pixel data $PD_{11}$ through $PD_{nm}$ as pixel drive data bits $DB2_{11}$ through $DB2_{nm}$, reads them one display line by one display line in accordance with read addresses supplied from the drive control circuit 4 and supplies them to the address driver 6. Subsequently, similarly, the memory 3 takes respective 3-th through N-th bits of the pixel data $PD_{11}$ through $PD_{nm}$ as the respective pixel drive data bits DB3 through DB(N), reads them one display line by one display line for each DB and supplies them to the address driver 6.

The drive control circuit 4 generates a reset pulse waveform adjusting signal RW having a level in accordance with the average brightness signal AL supplied from the average brightness level measuring circuit 2 and supplies it to an X row electrode driver 7 and a Y row electrode driver 8 respectively.

Figure 5:
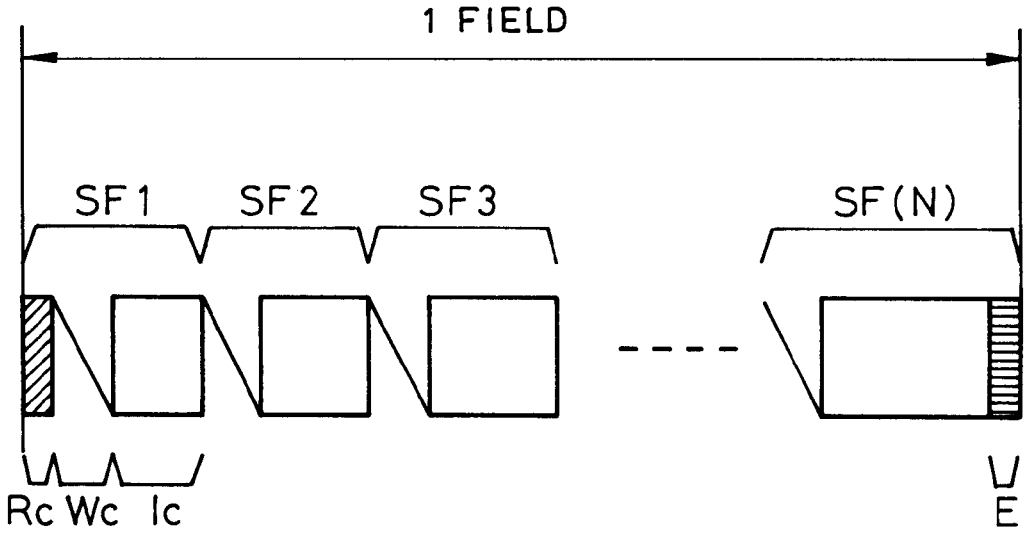
FIG. 5 is a diagram showing an example of a light emission drive format adopted in the plasma display apparatus shown in FIG. 4.

Further, the drive control circuit 4 generates various switching signals for driving PDP 10 in gray scale in accordance with a light emission drive format shown in FIG. 5 and supplies it to the address driver 6, the X row electrode driver 7 and the Y row electrode driver 8 respectively.

Further, according to the light emission drive format shown in FIG. 5, a display period of 1 field is divided into N of subfields SF1 through SF(N) and in the respective subfield, the pixel data writing step Wc and the light emission sustaining step Ic are carried out as mentioned above. Further, the simultaneous resetting step Rc is carried out only in the subfield SF1 at a front end and an erasing step E for extinguishing wall charge remaining in the respective discharge cell is carried out only in the subfield SF(N) at a final end.

Each of the X row electrode driver 7 and the Y row electrode driver 8 generates various drive pulses in accordance with various switching signals supplied from the drive control circuit 4 and applies them to row electrodes X and Y of PDP 10.

Figure 6:
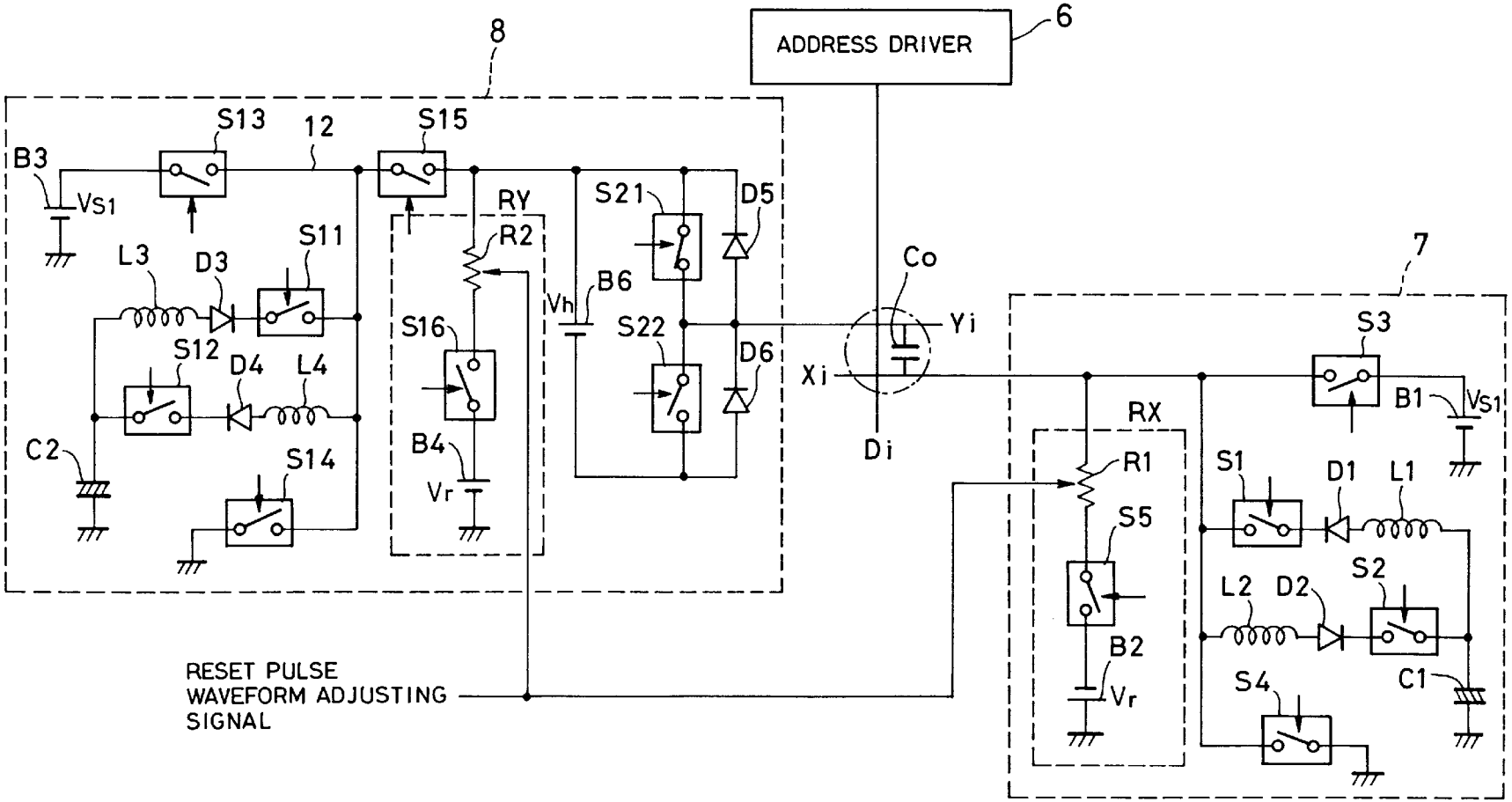
FIG. 6 is a diagram showing inner constitutions of an X row electrode driver 7 and a Y row electrode driver 8.

FIG. 6 is a diagram showing the internal construction of the X row electrode driver 7 and the Y row electrode driver 8.

As shown in FIG. 6, the X row electrode driver 7 is provided with a power source B1 for generating direct current voltage $V_{s1}$ and a power source B2 for generating direct current voltage $V_r$. A positive terminal of the power source B1 is connected to the row electrode X of PDP 10 via a switching element S3 and a negative terminal thereof is grounded. The row electrode X is grounded via a switching element S4. One end of a capacitor Ci is grounded, and connected between other end thereof and the row electrode X are a first series circuit comprising a coil L1, a diode D1 and a switching element S1 and a second series circuit comprising a coil L2, a diode D2 and a switching element S2 in parallel with each other. A positive terminal of the power source B2 is grounded and a negative terminal thereof is connected to the row electrode X of PDP 10 via a switching element S5 and a variable resistor R1. Further, a circuit comprising the power source B2, the switching element S5 and the variable resistor R1, constitute a reset pulse generating circuit RX for generating a reset pulse $RP_X'$, which will be described later.

Meanwhile, the Y row electrode driver 8 is provided with a power source B3 for generating direct current voltage $V_s$1, a power source B4 for generating direct current voltage $V_r$ and a power source B6 for generating direct current voltage $V_h$ as shown in FIG. 6. A positive terminal of the power source B3 is connected to a connection line 12 connected to a switching element S15 via a switching element S13 and a negative terminal thereof is grounded. The connection line 12 is grounded via a switching element S14. One end of a capacitor C2 is grounded, and connected between other end thereof and the connection line 12 are a first series circuit comprising a coil L3, a diode D3 and a switching element S11 and a second series circuit comprising a coil L4, a diode D4 and a switching element S12 in parallel with each other. The connection line 12 is connected to a connection line 13 connected to a positive terminal of the power source B6 via a switching element S15. A negative terminal of the power source B4 is grounded and a positive terminal thereof is connected to the connection line 13 via a switching element S16 and a variable resistor R2. Further, a circuit comprising the power source B4, the switching element S16 and the variable resistor R2, constitute a reset pulse generating circuit RY for generating a reset pulse $RP_Y'$, mentioned later. The connection line 13 is connected to the row electrode Y of PDP 10 via a switching element S21. Further, a negative terminal of the power source B6 is connected to the row electrode Y via a switching element S22. Further, a diode D5 is connected between the row electrode Y and the connection line 13 and a diode D6 is connected between the row electrode: Y and the negative terminal of the power source B6, respectively.

Figure 7:
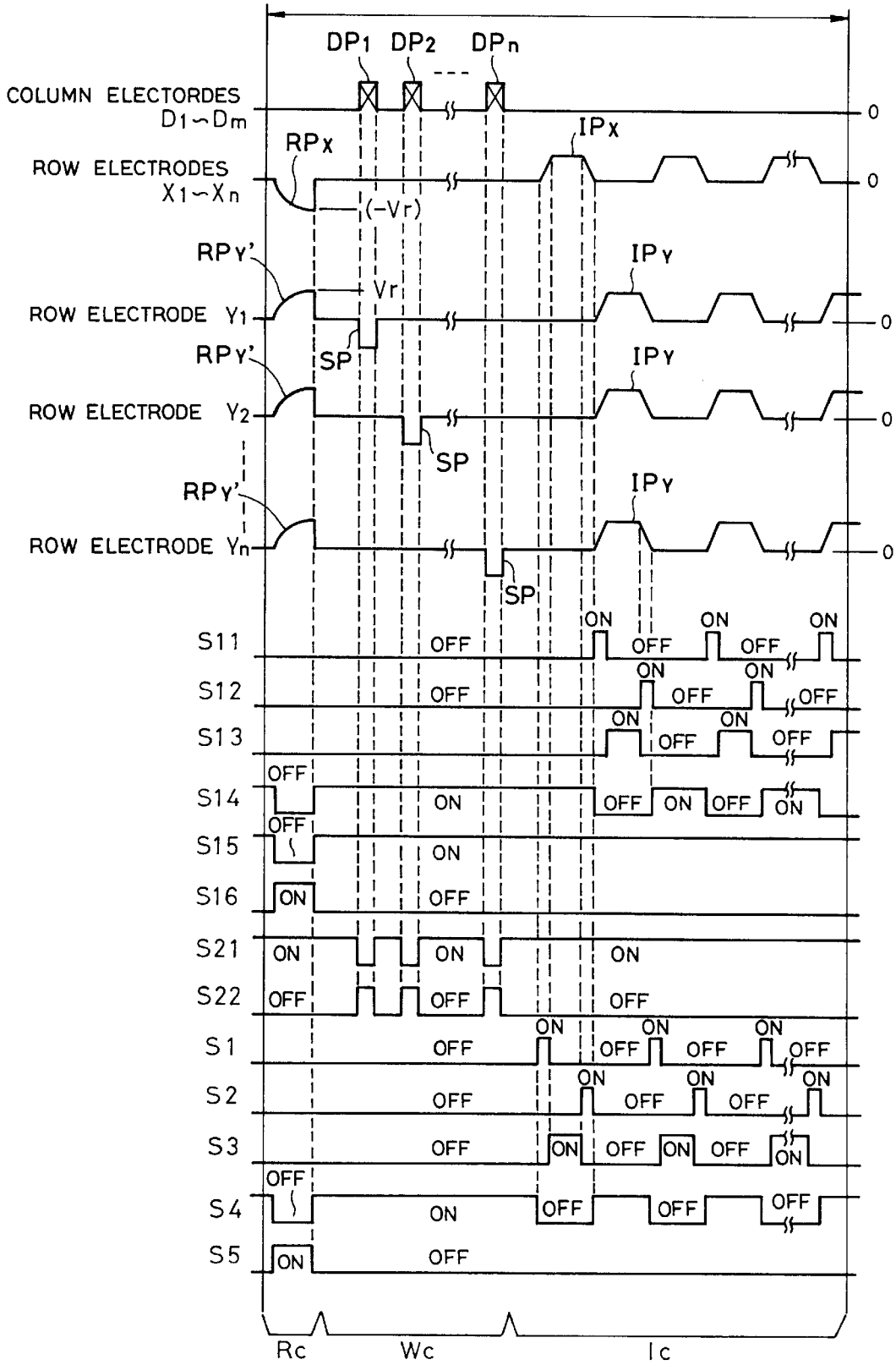
FIG. 7 is a diagram showing on/off sequences of respective switching elements S1 through S5, S11 through S16, S21 and S22, various drive pulses generated by operation of the switching elements and application timings thereof.

FIG. 7 is a diagram showing respective switching operation of the switching elements S1 through S5, S11 through S16, S21 and S22 controlled in accordance with various switching signals supplied from the drive control circuit 4, various drive pulses generated in accordance with the switching operation and application timings thereof. Further, FIG. 7 shows to extract only operation in the subfield SF1 at the front end in the light emission drive format shown in FIG. 5.

In FIG. 7, at the simultaneous resetting step Rc, the drive control circuit 4 respectively brings the switching element S5 of the X row electrode driver 7 and the switching elements S16 and S21 of the Y row electrode driver 8 into an ON state and brings the other switching elements into an OFF state. By bringing the switching element S5 of the X row electrode driver 7 into the ON state, current flows to a pass comprising the row electrode X, the variable resistor R1, the switching element S5 and the power source B2. In this process, voltage of the row electrode X gradually falls by an inclination in accordance with a time constant based on a load capacitance CO between the row electrodes of PDP 10 and a resistance value of the variable resistor R1. Further, by bringing the switching element S16 of the Y row electrode driver 8 into the ON state, current flows to the row electrode Y of PDP 10 via the power source B4, the switching element S16, the variable resistor R2 and the switching element S21. In this process, voltage of the row electrode Y gradually rises by an inclination in accordance with a time constant based on the load capacitance CO between the row electrodes of PDP 10 and a resistance value of the variable resistor R2. Further, at a timing at which the voltage of the row electrode X reaches negative voltage $-V_r$ based on the direct current voltage $V_r$ generated by the power source B2, the switching element S5 is switched to the OFF state and the switching element S4 is switched to the ON state, respectively. As a result, the reset pulse $RP_X'$ having pulse voltage $-V_r$ having a negative polarity is generated in which a change in the level at a front edge portion thereof (in falling) as shown in FIG. 7, is more gradual than those of a scan pulse SP and a sustaining pulse IP, which will be mentioned later. Further, the reset pulse $RP_X'$ is simultaneously applied to the row electrodes $X_1$ to $X_n$ respectively. Further, the drive control circuit 4 respectively switches the switching element S16 into the OFF state and switching elements S14 and S15 into the ON state at a timing at which the voltage of the row electrode Y reaches the direct current voltage $V_r$ generated by the power source B4. As a result, the reset pulse $RP_Y'$ is formed which has a pulse voltage $V_r$ of a positive polarity in which a change in the level at a front end portion (in rising) thereof as shown in FIG. 7, is more gradual than those of the scan pulse SP and the sustaining pulse IP, as will be described later. Further, the reset pulse $RP_Y'$ is simultaneously applied to the row electrodes $Y_1$ through $Y_n$ respectively.

In this case, as described above, the inclination of the front end portion of the reset pulse $RP_X'$ is determined by the resistance value of the variable resistor R1 and the inclination of the front end portion of the reset pulse $RP_Y'$ is determined by the resistance value of the variable resistor R2. Further, the resistance values of the variable resistors R1 and R2 are adjusted by the reset pulse waveform adjusting signal RW. Further, the reset pulse waveform-adjusting signal RW is generated by the drive control circuit 4 based on the average brightness signal AL representing the average brightness of one screen as mentioned above.

That is, the inclinations of the level changes of the respective front end portions of the reset pulses $RP_X'$ and $RP_Y'$ are adjusted in accordance with the average brightness of a displayed image.

Figures 8A, 8B, 8C:
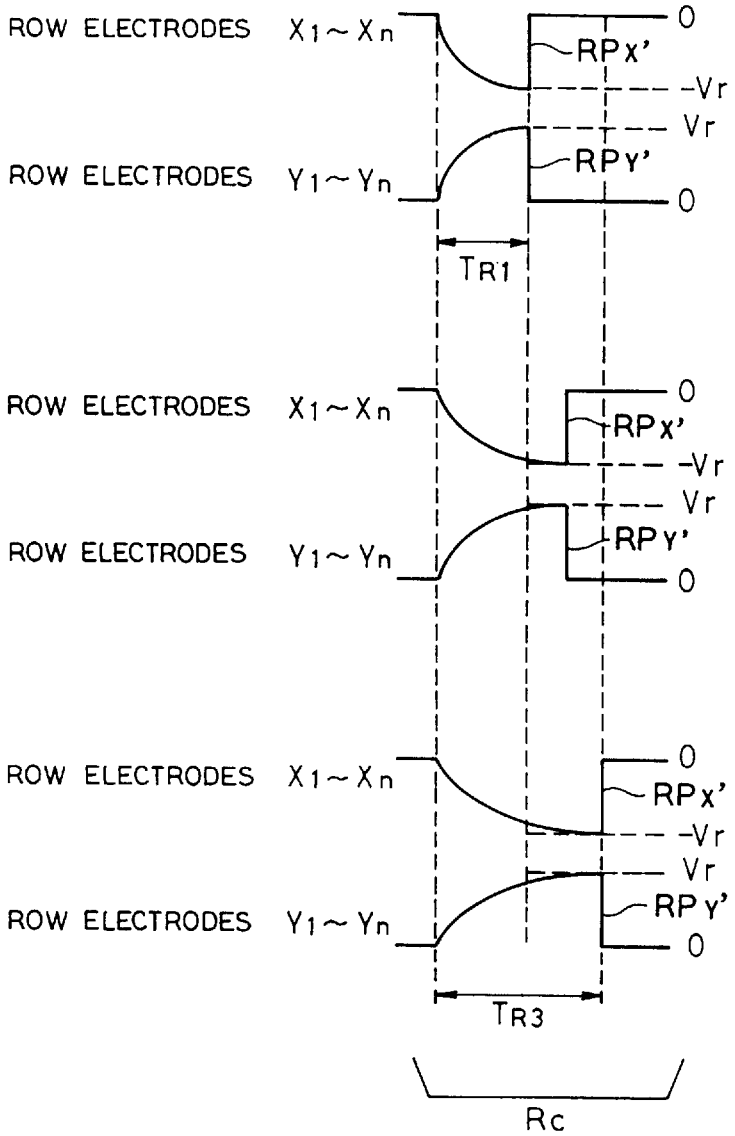
FIGS. 8A through 8C are diagrams showing waveforms of reset pulses RP' for respective brightness of a display image.

For example, when the average brightness of the displayed image is comparatively high, each of the X row electrode driver 7 and the Y row electrode driver 8 is supplied with the reset pulse waveform adjusting signal RW for rendering the level changes at the front edge portions of the reset pulses steep. In this process, the respective resistance values of the variable resistors R1 and R2 in the reset circuits RX and RY shown in FIG. 6 become low and the time constants are increased. Therefore, as shown in FIG. 8A, the level change at the front edge portion of the reset pulse $RP_X'$ ($RP_Y'$) becomes comparatively steep.

Meanwhile, in displaying an image of black or an image having low brightness near the black peak, the reset pulse waveform adjusting signal RW for rendering the level change at the front edge portion of the reset pulses gradual is supplied to the X row electrode driver 7 and the Y row electrode driver 8 respectively. In this process, the resistance values respectively of the variable resistors R1 and R2 become high and accordingly, the associated time constants are reduced. Therefore, as shown in FIG. 8C, the level change at the front end portion of the reset pulse $RP_X'(RP_Y')$ becomes more gradual than that in the case of FIG. 8A. Accordingly, in this case, a time period $T_{R3}$ before the level at the front end portion of the reset pulse $RP_X'(RP_Y')$ reaches the direct current voltage $-V_r$ ($V_r$), becomes longer than a time period $T_{R1}$ in the case of FIG. 8A. Furthermore, in displaying a normal image, that is, in displaying an image having an average brightness level, the respective resistance values of the variable resistors R1 and R2 are adjusted to middle degrees. Therefore, as shown in FIG. 8B, the level change at the front end portion of the reset pulse $RP_X'(RP_Y')$ in this case is more gradual than that shown FIG. 8A and is more steep than that shown in FIG. 8C.

In accordance with simultaneous application of the above-described reset pulses $RP_X'(RP_Y')$, all of the discharge cells of PDP 10 are reset discharged and after finishing the reset discharge thereof, a predetermined amount of wall charge is formed and held uniformly in the respective discharge cells. Further, although pulse light emission is caused in accordance with the reset discharge, the more gradual the level change at the front end portion of the reset pulse $RP_X'(RP_Y')$, the lower the brightness of light emission. That is, according to the reset pulse $RP_X'(RP_Y')$ having the falling (rising) change as shown in FIG. 8C, the brightness of light emission associated with the reset discharge created by the reset pulse becomes lower than that in the case of FIG. 8A.

By carrying out the simultaneous resetting step Rc, all of the discharge cells in PDP 10 are initialized to a state capable of emitting light (sustaining discharge) in a light emission sustaining step Ic, mentioned later (hereinafter, referred to as "light emitting cell" state").

Next, at a pixel data writing step Wc shown in FIG. 7, the address driver 6 generates a pixel data pulse having pulse direct current voltage in accordance with a pixel drive data bit DB supplied from the memory 3. For example, the address driver 6 generates a pixel data pulse having high direct current voltage when the logical level of the pixel drive data bit DB is "1" and generates a pixel data pulse having low direct current voltage (0 volt) when the logical level is "0". Further, the address driver 6 applies a group of the pixel data pulses $DP_1$ through $DP_n$ constituted by grouping the pixel data pulses for respective single display line successively to the column electrodes $D_1$ through $D_n$ as shown in FIG. 7. Further, according to the pixel data writing step Wc, the Y row electrode driver 8 generates the scan pulses SP having a negative polarity at timings the same as timings of the application of the group of pixel data pulses $DP_1$ through $DP_n$ respectively and successively applies the scan pulses SP to the row electrodes $Y_1$ through $Y_n$. Further more, as shown in FIG. 7, the scan pulse SP is generated by turning the switching element S21 to the OFF state and turning the switching element S22 to the ON state. In this process, a discharge (selective erasure discharge) is created only in discharge cells at intersection portions of the display line applied with the scan pulse SP and the "columns" to which the pixel data pulse of a high direct current voltage is applied. By the selective erasure discharge, the wall charge held in the discharge cell is extinguished and the discharge cell is shifted to a state in which light emission (sustaining discharge) cannot be carried out in the light emission sustaining step Ic, which will be described later (hereinafter, referred to as "non light emitting cell" state). Meanwhile, the selective erasure discharge is not created in discharge cells applied with a pixel data pulse of a low direct current voltage even when the scan pulse SP is applied, and the discharge cells maintain the state initialized at the simultaneous resetting step Rc, that is, the state of the "light emitting cell".

As a result of this pixel data writing step Wc, the respective discharge cell of PDP 10 is set to either of the "light emitting cell" state and the "non light emitting cell" state in accordance with the pixel data based on the input image signal.

Next, in the light emission sustaining step Ic shown in FIG. 7, sustaining pulses $IP_X$ and $IP_Y$ having a positive polarity are generated by operating the respective switching elements S1 through S4 and S11 through S14 of the X row electrode driver 7 and the Y row electrode driver 8 in accordance with on/off sequences as shown in the drawing. The X row electrode driver 7 and the Y row electrode driver 8 respectively apply the sustaining pulses $IP_X$ and $IP_Y$ having the positive polarity to the row electrodes X and Y alternately repeatedly as shown in FIG. 7. In this case, the number of times (periods of time) of the sustaining pulses IP to be applied in the respective light emission sustaining steps Ic, are set in accordance with the weighting of the respective subfields. In this case, only a discharge cell formed with the wall charge, that is, only discharge cells brought into the "light emitting cell" state in all of the discharge cells in PDP 10, carry out the sustaining discharge each time the sustaining pulses $IP_X$ and $IP_Y$ are applied. That is, only the discharge cells set to the "light emitting cell" state in the pixel data writing step Wc, repeat the light emission in accordance with the sustaining discharge a number of times set in accordance with weighting of the subfield, and maintain the light emitting state.

As described above, according to the invention, in applying the reset pulses having the gradual level changes at the front edge portions to all the discharge cells, the time period before the level at the front edge portion reaches a predetermined level ($V_r$ or $-V_r$), is adjusted in accordance with the average brightness of the displayed image. In this case, in displaying an image of black display or an image having low brightness extremely near to black display, the time period before the level at the front edge portion of the reset pulse reaches the predetermined level, is prolonged as compared with that in the case of displaying an image having a high brightness. As a result of this type of adjustment, the reset discharge is caused gradually from a discharge cell having comparatively low discharge start voltage to a discharge cell having high discharge start voltage and therefore, the brightness of light emission associated with the reset discharge is lowered in comparison with a case in which the reset discharge is created simultaneously in all of the discharge cells.

Therefore, according to the invention, in displaying an image of black display or an image having low brightness extremely near to black display, the brightness of light emission associated with the reset discharge is lowered and therefore, the lowering of contrast in those cases can be prevented.

Further, in the above-described embodiment, as a method of writing the pixel data, a description has been made to the case that utilizes the so-called selective erasure address method in which the wall charge is formed previously at the respective discharge cell and the wall charge is erased selectively in accordance with the pixel data to thereby write the pixel data.

However, it should be noted the invention is applicable similarly to the case of adopting the so-called selective write address method in which the wall charge is formed selectively in accordance with the pixel data as a method of writing the pixel data.

Figure 9A:
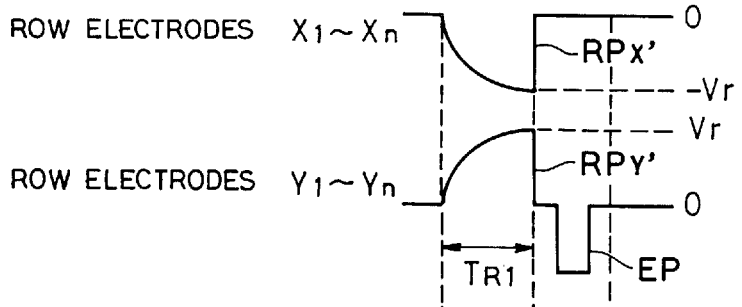
FIGS. 9A through 9C are diagrams showing waveforms of reset pulses RP' applied in a simultaneous resetting step Rc and an erasure pulse EP when a selective write address method is adopted.
Figure 9B:
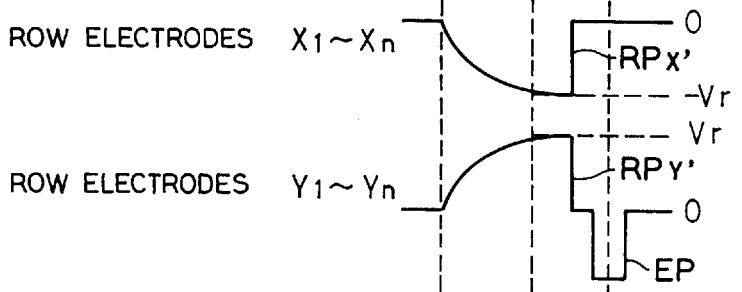
Figure 9C:
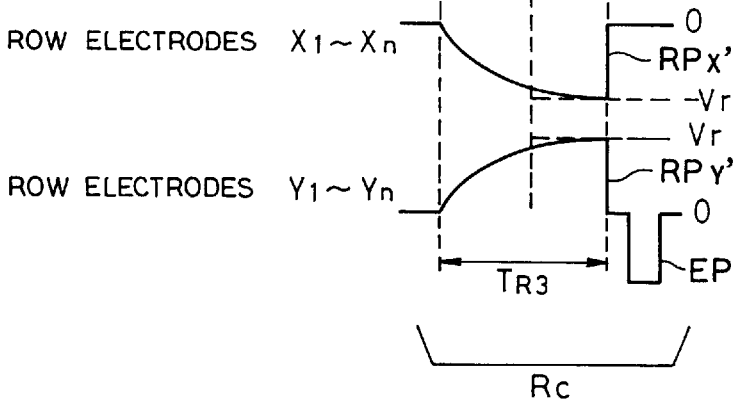

When the selective write address method is adopted, in the simultaneous resetting step Rc, an erasure pulse EP having a negative polarity is simultaneously applied to each of the row electrodes $Y_1$ through $Y_n$ immediately after applying the reset pulse $RP_Y'$ as shown in FIG. 9A through FIG. 9C. Further more, FIG. 9A is a diagram showing respective waveforms of the reset pulses $RP_Y'$ and $RP_X'$ and the erasure pulse EP and the timings of application thereof when displaying an image having a high brightness, FIG. 9C is a diagram showing these pulses when displaying a black image or an image having a low brightness near to the black peak and FIG. 9B is a diagram showing these pulses when displaying an image having an average brightness level.

According to the simultaneous resetting step Rc in the case of adopting the selective write address method, all of the wall charge formed in all of the discharge cells by applying the reset pulses $RP_Y'$ and $RP_X'$, is distinguished by applying the erasure pulse EP shown in FIGS. 9A through 9C. That is, all the discharge cells are shifted to the "non light emitting cell" state in accordance with the application of the erasure pulse EP. Next, in the pixel data writing step Wc when adopting the selective write address method, the discharge (the selective write discharge) is caused only in discharge cells to which the scan pulse SP having the negative polarity and the pixel data pulse having high direct current voltage are applied simultaneously. Among all the discharge cells in PDP 10, the wall charge is formed only in the discharge-cells at which the selective writing discharge is created and the discharge cells are shifted to the "light emitting cell" state. Further, the operation in the light emission sustaining step Ic in the case where the selective write address method is adopted, is similar to that in the case where the selective erasure address method is adopted. Therefore, an explanation thereof will not be repeated.

Figures 10A, 10B, 10C:
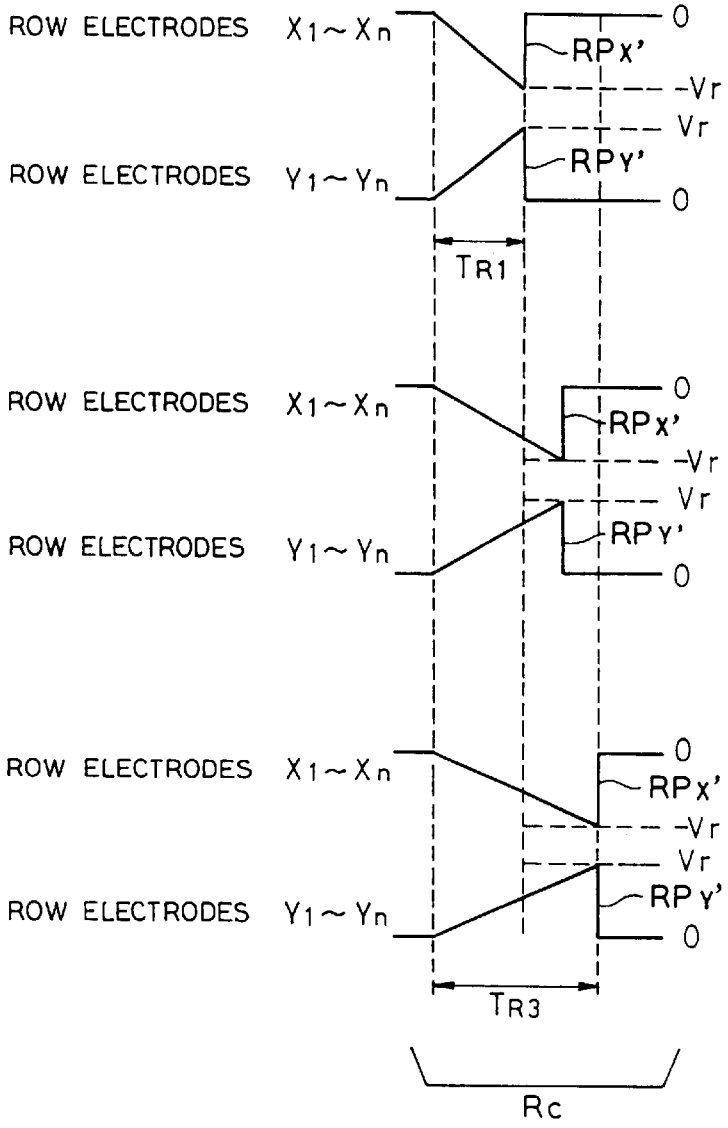
FIGS. 10A through 10C are diagrams showing other waveforms of reset pulses RP'.

Although the embodiments shown in FIG. 8A through FIG. 8C and FIG. 9A through FIG. 9C are configured that the change in the level at the front edge portion of the reset pulse $RP_Y'$ ($RP_X'$) is formed in a curve, the change in the level may be in a linear shape as shown in FIG. 10A through FIG. 10C.

In summary, when the average brightness of the displayed image is high, a rate of the change in the level at the front edge portion of the reset pulse $RP_Y'$ ($RP_X'$) is adjusted to be large as shown in FIG. 10A, meanwhile, when the average brightness of the displayed image is low, the rate of the change in the level is adjusted to be small as shown in FIG. 10C.

As described above, according to the invention, in applying the reset pulse having the gradual change in the level at the front edge portion to all the discharge cells, the time period before the level at the front edge portion reaches a predetermined level, is adjusted in accordance with the average brightness of the displayed image.

Therefore, in displaying a black image or an image having a low brightness level extremely near to black peak, the brightness of light emitted in association with the reset discharge is lowered and a deterioration in contrast in such event can be prevented by prolonging the time period before the front edge portion of the reset pulse reaches the predetermined level.

This application is based on Japanese Patent Application No. 2000-191183 which is hereby incorporated by reference.

What is claimed is:

1. A method for driving a plasma display panel, in which a plurality of discharge cells constituting display pixels are arrange in a matrix form, in accordance with an image signal, said method comprising:

a simultaneous resetting step for applying reset pulses having gradual level changes at front edge portions thereof to said discharge cells respectively, to cause a reset discharge for initializing said respective discharge cells to either of a light emitting cell state and a non light emitting cell state respectively;

a pixel data writing step for applying a scan pulse for causing selective discharge to said discharge cells for shifting said discharge cells selectively to the no light emitting cell state or the light emitting cell state in accordance with pixel data corresponding to said image signal; and a light emission sustaining step for respectively applying, to said discharge cells, sustaining pulses for causing a sustaining discharge that causes only discharge cells brought into the light emitting cell state to emit light repeatedly;

wherein said simultaneous resetting step includes a reset pulse waveform adjusting step of adjusting a time period before a level at the front edge portion of said reset pulse reaches a predetermined level in accordance with an average brightness level of said image signal.

2. The method for driving a plasma display panel according to claim 1:

wherein the level change at said front edge portion of said reset pulse is more gradual than level changes of respective front edge portions of said scan pulse and said sustaining pulse.

3. The method of driving a plasma display panel according to claim 1:

wherein in said reset pulse waveform adjusting step, when said average brightness level of said image signal is low, a time period before the level at the front edge portion of said reset pulse reaches said predetermined level is made longer than a corresponding time period when said average brightness level of said image signal is high.

4. A method for driving a plasma display panel, in which a plurality of discharge cells constituting display pixels are arranged in a matrix form, in accordance with an image signal, said method comprising:

a simultaneous resetting step for applying reset pulses having gradual level changes at front edge portions thereof to said discharge cells respectively, to cause a reset discharge for initializing said respective discharge cells to either of a light emitting cell state and a non light emitting cell state respectively;

a pixel data writing step for applying a scan pulse for causing a selective discharge to said discharge cells for shifting said discharge cells selectively to said non light emitting cell state or said light emitting cell state in accordance with pixel data corresponding to said image signal; and a light emission sustaining step of applying to each of said discharge cells sustaining pulses to create a sustaining discharge that causes only discharge cells brought into the light emitting cell state to emit light repeatedly;

wherein said simultaneous resetting step includes a reset pulse waveform adjusting step of adjusting a rate of a level change at said front edge portion of said reset pulse in accordance with an average brightness of said image signal.

5. The method of driving a plasma display panel according to claim 4:

wherein said level change at said front edge portion of said reset pulse is more gradual than level changes in respective front edge portions of said scan pulse and said sustaining pulse.

6. The method of driving a plasma display panel according to claim 4:

wherein in said reset pulse waveform adjusting step, when said average brightness level of said image signal is low, said rate of said level change at said front edge portion of said reset pulse is made smaller than a corresponding rate when said average brightness level of said image signal is high.

7. A plasma display apparatus which is a plasma display apparatus for driving a plasma display panel, in which capacitive discharge cells constituting display pixels are arranged in a matrix form, in accordance with an image signal, said apparatus comprising:

a reset pulse generating part for generating reset pulses for creating a reset discharge that initializes said discharge cells to either of a light emitting cell state and a non light emitting cell state respectively;

a light emission driving part for selectively shifting said discharge cells to said non light emitting cell state or said light emitting state in accordance with said image signal and causing only discharge cells brought into said light emitting cell state to emit light repeatedly; and an average brightness level measuring part for measuring an average brightness level of said image signal;

wherein said reset pulse generating part comprises:

a power source for generating a direct current power source voltage having a voltage value identical with a pulse voltage value of said reset pulse;

a part for generating said reset pulse by applying said direct current power source voltage to said discharge cells respectively via resistors; and a reset pulse waveform adjusting part for adjusting time constants of C-R circuits each comprising said discharge cell as a capacitive load and said resistor in accordance with said average brightness level.

8. The plasma display apparatus according to claim 7:

wherein when said average brightness level is low, said reset pulse waveform adjusting part performs an adjustment to make said time constant larger than a corresponding time constant when said average brightness level is high.

9. The plasma display apparatus according to claim 7:

wherein said reset pulse waveform adjusting part adjusts said time constant by changing a resistance value of said resistor in accordance with said average brightness level.

* * * * *